US008136571B2

(12) United States Patent
DeBruin

(10) Patent No.: US 8,136,571 B2
(45) Date of Patent: Mar. 20, 2012

(54) CARBIDIC OUTER EDGE DUCTILE IRON PRODUCT, AND AS CAST SURFACE ALLOYING PROCESS

(76) Inventor: Mark DeBruin, Youngstown, OH (US)

( * ) Notice: Subject to any disclaimer, the term of this patent is extended or adjusted under 35 U.S.C. 154(b) by 0 days.

(21) Appl. No.: 12/800,557

(22) Filed: May 18, 2010

(65) Prior Publication Data

US 2010/0296961 A1 Nov. 25, 2010

Related U.S. Application Data

(60) Provisional application No. 61/216,603, filed on May 19, 2009.

(51) Int. Cl.
*B22C 9/04* (2006.01)
*B22D 27/00* (2006.01)

(52) U.S. Cl. ..... 164/34; 164/57.1; 164/58.1

(58) Field of Classification Search ..... 164/34, 164/55.1, 57.1, 58.1
See application file for complete search history.

(56) References Cited

U.S. PATENT DOCUMENTS

| | | | | |
|---|---|---|---|---|
| 4,035,204 | A | 7/1977 | Hack et al. | 148/210 |
| 4,070,920 | A | 1/1978 | LeBlanc | 74/446 |
| 4,520,858 | A | 6/1985 | Ryntz, Jr. et al. | 164/34 |
| 4,531,985 | A | 7/1985 | Tommis | 148/219 |
| 5,000,244 | A | 3/1991 | Osborne | 164/34 |
| 5,027,878 | A * | 7/1991 | Revankar et al. | 164/98 |
| 5,429,172 | A | 7/1995 | Hand | 164/34 |
| 5,547,521 | A | 8/1996 | Hand | 148/522 |
| 5,729,822 | A | 3/1998 | Shivanath et al. | 428/551 |
| 5,746,842 | A | 5/1998 | Eguchi et al. | 148/319 |
| 5,869,019 | A | 2/1999 | Seegopaul | 423/440 |
| 6,251,819 | B1 | 6/2001 | Prin et al. | 502/178 |
| 6,305,458 | B1 | 10/2001 | Gligor | 164/34 |
| 6,416,728 | B2 | 7/2002 | Inoue et al. | 423/439 |
| 6,478,074 | B1 | 11/2002 | Basler et al. | 164/34 |
| 6,527,877 | B1 | 3/2003 | Dorofeev | 148/320 |
| 6,702,981 | B2 | 3/2004 | Hetzner | 420/112 |
| 6,790,295 | B2 | 9/2004 | Kinoshita et al. | 148/226 |
| 6,799,648 | B2 * | 10/2004 | Brandenberg et al. | 175/420 |
| 6,901,989 | B1 | 6/2005 | Sargent et al. | 164/34 |
| 6,955,626 | B2 | 10/2005 | Yoshihama et al. | 475/248 |
| 6,971,437 | B1 | 12/2005 | Cossey | 164/235 |
| 7,081,174 | B2 | 7/2006 | Hayashi et al. | 148/598 |
| 7,172,011 | B2 | 2/2007 | Bing et al. | 164/34 |
| 7,213,634 | B1 | 5/2007 | Evans et al. | 164/133 |
| 7,360,577 | B2 | 4/2008 | Pederson et al. | 164/34 |
| 7,416,614 | B2 | 8/2008 | Tachisato | 148/225 |
| 7,468,107 | B2 | 12/2008 | Tipps et al. | 148/233 |
| 2008/0145645 | A1 * | 6/2008 | Lemke et al. | 428/323 |

* cited by examiner

*Primary Examiner* — Kevin P Kerns
(74) *Attorney, Agent, or Firm* — Robert G. Lev

(57) ABSTRACT

A process is used for applying carbiding agents to the surface of ferrous metal castings, using the "lost foam" method. Carbiding agents are applied to the foam form at selected places so that the final product has the desired amount of carbidic content at the right locations to endure high stress applications on the casting.

11 Claims, 1 Drawing Sheet

FIG. 1
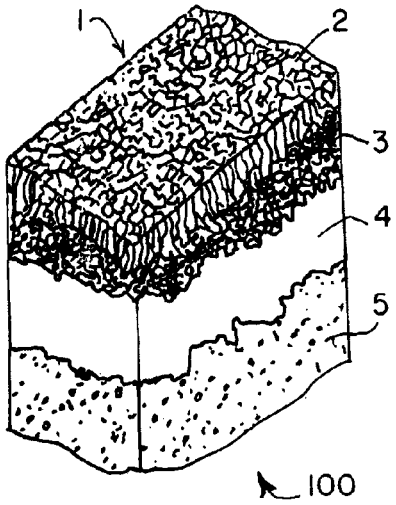
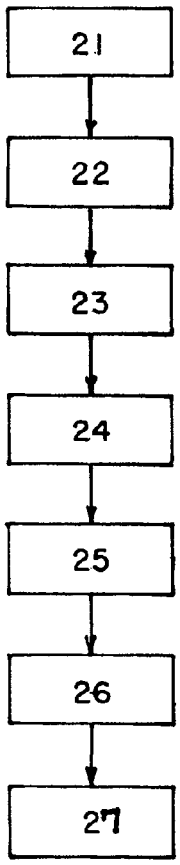
FIG. 2

CARBIDIC OUTER EDGE DUCTILE IRON PRODUCT, AND AS CAST SURFACE ALLOYING PROCESS

PRIORITY INFORMATION

The present invention claims priority to U.S. Provisional Application No. 61/216,603 filed on May 19, 2009, making reference herein to same in its entirety.

FIELD OF INVENTION

The present invention concerns the field of metal casting, especially using ferrous materials such as ductile iron, and steel. In particular, the present invention is directed to the use of the "lost foam" method for producing ferrous castings.

BACKGROUND ART

Iron and steel machine parts having both complex geometries and accurate dimensions have been manufactured for well over a century. Traditionally such complex metallic parts were individually machined, achieving precise dimensions. However, it is faster, cheaper and easier to cast such parts using metals in the molten state, especially for mass production of parts, as is required in modern manufacturing. If casting operations are conducted properly, both uniformity of the material and efficiency of the manufacturing process can be optimally enhanced, at least in theory.

A major drawback of traditional "green sand" (a mixture of sand, clay and water) casting (like that used since antiquity), is that close tolerances in the cast part are very difficult to achieve, as is a smooth finish. The situation with "green sand" casting becomes even more problematical when mass production is involved so that variances in dimensions increase, thereby undermining interchangeability of parts. As the level of required tolerances becomes more exacting, it becomes necessary to add post-casting machining steps to the overall manufacturing process. This entails substantial expense, especially with ferrous castings.

Another problem with ferrous metal castings arises with the duty cycle to be imposed upon the finished parts. For example, grey iron is easier to produce, and has some beneficial properties, such as dampening ability. However, grey iron has intrinsically lower ductility compared to many other metals, making it useless for many applications in which a more ductile product is needed. Steel castings, while providing greater ductility, have a whole range of manufacturing difficulties, and uniformity of composition issues. The scope of such limitations is well-known in the casting art, and requires no further discussion here for an understanding of the general limitations of the conventional art of casting ferrous metals.

Up to the last sixty years, these limitations constituted serious constraints upon the usefulness of both iron and steel castings. Part of the solution was provided by the development of ductile iron, over sixty years ago. This is a well-known product that varies from standard grey iron or steel by the addition of spheroidal graphite nodules throughout the metallic matrices. The result is a high level of ductility. In contrast, in grey iron or cast iron, the carbon which is not in the pearlite portion of the product is in the form of irregular flake graphite, resulting in a relatively brittle product.

Traditionally, ductile iron has been made as carbide free as possible, for both machining and mechanical considerations. This is done in order to control the location of the carbides, which if not controlled, would form randomly or at the center of the metallic part. Such randomness is generally considered undesirable for a specifically engineered end product having close tolerances, as it can degrade or cause erratic material properties, As a result carbides are conventionally regarded as anathema to ductile iron processes.

A further description of ductile iron characteristics and methods of manufacture can be found in the *Ductile Iron Handbook*, the 1993 revision, American Foundrymen's Society, Inc., DesPlains, Ill.; ISBN-87433-124-2. This work is incorporated herein by reference as an example of traditional ductile iron characteristics, use, manufacturing, and limitations. Accordingly, no further description of ductile iron is necessary for an understanding of the present invention.

The use of ductile iron for casting overcomes the traditional grey iron problem of loss of ductile properties. However, the other drawbacks of the conventional art still remain. For example, the lack of reasonably close tolerances resulting from traditional "green sand" casting. More problematical is the difficulty in hardening specific portions of ductile iron castings. Conventionally this is almost impossible unless there is a secondary heat treating process. Such a process entails substantial additional expense.

The casting art became far more precise with the introduction of "lost foam" casting in 1958. The initial versions of this technique used a pattern or form made from a block of expanded polystyrene (EPS), which was supported by "green sand" during the metal pour. This process has officially been known as the full mold process. Additional developments in this technology included the use of unbonded or common sand in the process. This particular variation is now commonly known as the "lost foam" method.

The Appendix attached hereto includes an article from the American Foundrymen's Society, AFS division 11: "Lost Foam Casting". This document is incorporated herein by reference as an example of conventional "lost foam" casting that can be applied to a variety of different metals.

Unfortunately, even with the aforementioned improvements, there are still many drawbacks in the art of manufacturing precise ferrous castings. In particular, there is still substantial difficulty in producing cast parts with appropriate (hardened) load bearing surfaces, such as those used in gears or other high-stress machinery. Even with the conventional improvements to date, modern ductile iron is not sufficiently hard for many applications, especially those that require specific, high-stress, load-bearing surfaces.

At the same time, traditional grey iron is too brittle for many extremely stressful duty cycles, such as those that would be found in many machinery arrangements, such as gears, bearing plates, and the like. Attempts to use traditional carburizing or hardening, such as that found in many steel products, leads to very complex processing that can include melting, casting, rolling, machining, heat treating, and finish machining. This is very expensive, time consuming, and extremely demanding. Such processes do not admit easily to simple and inexpensive mass production of the desired parts.

Accordingly, there is a substantial need for providing cast ductile iron or steel parts that have selected carbide surfaces to withstand high-stress duty cycles. Such a process should be inexpensive, and adapted to use existing equipment and techniques.

SUMMARY OF INVENTION

It is the primary object of the present invention to overcome the conventional difficulties and limitations of cast ferrous parts used in high-stress duty cycles, or for load bearing applications.

Another object of the present invention is to provide a cast ductile iron or steel part that has hardened load bearing surfaces only where specifically required, and only on portions of the outer surface of the cast piece.

It is a further object of the present invention to provide a ductile iron or steel casting that can be used in an "as-cast" state, with little or no post-cast machining.

It is an additional object of the present invention to provide a simplified, inexpensive method for forming a complex carbidic outer surface on a ductile iron or steel casting.

It is still another object of the present invention to provide a ductile iron casting in which a closely configured hard carbide surface layer is formed into an increasingly ductile iron body.

It is yet a further object of the further invention to provide specialized carbide patterns on ferrous castings using the "lost foam" casting method, with little post-casting modification.

It is still another object of the present invention to provide a method of casting a wide variety of metals whereby the carbide content of the surface of the casting and its depth into the material beneath the surface, can be exactly controlled.

It is still an additional object of the present invention to provide a method of casting a wide variety of ferrous metals whereby the surface of the casting is selectively alloyed from the surface downward into the casting.

It is again a further object of the present invention to provide a method for casting ferrous parts in which surface heat treating can be eliminated for load bearing surfaces.

It is yet an additional object of the present invention to provide a system wherein precise ductile iron and steel castings can be made quickly and inexpensively.

These and other goals and objects of the present invention are achieved by a "lost foam" method of forming carbides as part of at least one preselected portion of a ferrous metallic casting. First, a vaporizable form in the shape of a desired ferrous metallic casting is provided. Then a carbidic formation agent is placed on selected portions of the vaporizable form. These selected portions correspond to preselected surface portions which are to have carbidic surfaces. Then, the form is placed in a container and surrounded with sand. Finally, molten ferrous metal is applied to the mold, vaporizing the mold to form the ferrous metallic casting.

In another embodiment of the present invention a ductile iron casting is provided having a ductile iron body constituting the bulk of the casting. At least one preselected portion of carbide is formed over a precise, preselected portion of a surface of the casting and into the surface of the casting to a preselected depth, as originally cast.

BRIEF DESCRIPTION OF DRAWINGS

FIG. 1 is perspective drawing depicting various layers of the final product of the present invention.

FIG. 2 is a flow diagram depicting the various steps of creating the final product.

DETAILED DESCRIPTION OF PREFERRED EMBODIMENTS

FIG. 1 depicts a relatively small rectangular section 1 of a ductile metal casting 100. The carbide surface 2 can be of any shape desired for a particular casting or surface. The carbide layer 2 is relatively uniform on the surface of the casting and can be anywhere from 0.001 to 0.250 inches thick. The carbide layer 2 extends into the body of the casting 100. In particular, there is an extension of the carbide layer 2 into a layer of fine bainite 3 having graphite nodules. Beneath the fine bainite layer 3 there is a coarse bainite layer 4 having graphite nodules. Underneath this is the body of the ductile iron base 5. This ductile iron base is the same as that of conventional ductile iron described by reference.

The key to this product is that the carbide layer 2 can be placed precisely at desired points on the surface of casting 100, and only at those desired areas such as area 1. The carbide layer 2 can be on any portion of the final casting 100, but is always located on an outer edge or surface as depicted in FIG. 1.

The present selective and precise placement of the carbide layer 2 differs substantially from the conventional art. When using traditional processing methods, the location of carbides cannot be controlled to this extent in ductile iron. As a result, carbides would form randomly or just remain near the center of the casting, providing a questionable product, or complete failure to produce ductile iron. Conventional techniques are possible only on simple shapes, and the depth of carbide cannot be controlled. Also, the shape of the carbide cannot be precisely controlled, and the surrounding microstructure would differ. Conventionally, carbide formation in ductile iron is considered destructive of the product and the overall process.

The wear properties of the surface carbide layer 2 are similar to those obtained through conventional heat treating steel processes. With the present invention, all randomness associated with the presence of carbides in ductile iron is eliminated through the novel process of specifically forming individual carbide-covered areas 2 on the casting 100. By using the "lost foam" process, very tight dimensional controls are obtained along with the exact placement of the carbide surface layer 2. Further, there is virtually no machining required after the casting process.

While the use of carbiding agents is acceptable with steel, or grey iron, conventionally it is entirely anathema to the processing of ductile iron, or any ductile iron products. The randomness of carbide formation in a ductile iron casting traditionally cannot be controlled with respect to placement of carbide formation either within or on a cast ductile iron product. If the carbides are not controlled, it can lead to substantial machining problems and mechanical property degradation when the ductile iron casting is finished.

For example, tellurium is very strong carbidic formation agent, and usually cannot be controlled for the formation of carbide parts or layers. Approximately, 0.01% of tellurium in a ductile iron melt supply will produce random carbides to such an extent that it becomes very detrimental to machining the final product. Further, this amount or more will almost certainly prevent the formation of the ductile iron end product entirely.

Accordingly, tellurium and other strong carbide forming agents are not permitted in plants in which ductile iron is conventionally manufactured or otherwise processed into particular parts. In normal practice, carbide forming agents are banned from ductile iron facilities since even small amounts would contaminate the entire system to the point that it would become useless. As such, the conventional use of carbide forming agents with ductile iron processing is entirely anathema. A normal practitioner in the ductile iron art would never consider the use of any kind of carbide forming agent in any ductile iron process.

The present invention includes the use of carbidic agents in ductile iron processing to obtain the inventive product of FIG. 1. The carbidic outer edge or surface 1 for the ductile iron 5, is relatively easy to identify using a microscope. A clear identifier is a layer of carbides 2 on just the surface of the portion 1, then a layer of fine bainite 3 extends to a layer of coarse bainite 4 into the standard ductile iron 5 (ferrite and pearlite). Ductile nodules will be found throughout the body 5 of the sample. Also, the carbide layer 2 will be relatively uniform, in depth, and can be very precise in its surface dimensions.

The specialized and precise product of FIG. 1 is made using a modified "lost foam" casting technique as depicted in FIG. 2. The first part, as in any casting process, is to make a pattern, or a form (step 21). Preferably, the form is made of expanded polystyrene (EPS), or a similar material. The materials suitable for the "lost foam" process are already well-known, and all share the same characteristic of being vaporized by the metallic melt that is applied into the area of expanded polystyrene form (see Appendix 1). It should be noted that a large single form can be used, or a number of smaller forms can be clustered together, and subjected to the rest of the process of FIG. 2.

A key aspect of the novel process of FIG. 2 is the application of a coat of carbiding agents (step 22) to selected portions of the polystyrene form. Any number of carbide forming coatings can be used. These include, but are not limited to, vanadium, chromium, niobium, and tellurium. While this group of carbiding agents is preferred, other different types of carbiding agents can be applied. For practical reasons, the carbiding agent is precisely applied to selected areas of the form using any applicable method. The carbiding agent can be placed into a solution where it is easily handled and easily adheres to the polystyrene form.

While the use of a paint brush is adequate for many applications, other application techniques can be used. For example, a spraying mechanism can be used to apply the carbiding agent. This can be used in conjunction with templates, or a pre-programmed precision spraying system, if such proves desirable. Even patterns of dried carbiding agent can be precisely layered over the form.

The placement of the carbide forming material directly on the EPS form is important since the metallic pour will replace the EPS foam in a thermodynamic reaction, which also causes a chemical reaction, which is unrelated to the present invention. The result, however, is that a precise carbide surface is formed into the metallic pour at the precise point where the carbide forming coating has been placed on the EPS form. The resulting carbide area is depicted in FIG. 1.

Before the metal melt is applied to a mold holding the EPS form, a standard refractory coating is applied (step 23). Usually such coatings are water soluble, and take no part in the reaction with the carbide agent painted directly on the EPS form. Such coatings are standard in the well-developed art of "lost foam" casting, and need no further elaboration for purpose of the present invention.

Once the refractory coating has dried, covering both polystyrene form and the carbide agent on the form, the polystyrene form is suspended in a sand chamber serving as a mold. Sand is applied (step 24) filling all spaces around the EPS form. The sand, used for both filling and compaction at step 24, is a common, unbonded sand normally used with a "lost foam" casting process. The sand used is not a silica base sand. Rather, it is a dry, mined, and screened product with no additives. Traditional foundries (those not using the "lost foam" casting method) use "green sand", which is wet sand, constituted by a mixture of water, clay and other additives, or a plastic resin bonded sand.

A key difference is that by using the "lost foam" technique, a much smoother surface is obtained using just the casting method. As a result, substantial post-casting machining of the cast part is not necessary. The use of standard sand with the "lost foam" method is crucial to obtaining the desired surface characteristics of the casting.

In step 25, the metal pour is applied directly to the area of the EPS form. The polystyrene is vaporized and replaced by the molten metal, such as ductile iron. The handling of the molten pour and the cooling of the casting are all well-known in the technology of the "lost foam" technique, and the general characteristics of ductile iron.

The shake out of the casting occurs at step 26. With this step, the casting is removed from the mold or container and the sand shaken away from the casting. The refractory coating (applied at step 23) is removed (step 27) using a variety of different techniques. One such example is shot blasting which provides an efficient method of cleaning the refractory coating from the casting, and providing further smoothing of the casting. The carbided portions of the casting are not affected by the shot blasting. It should be understood that other types of cleaning techniques (to remove both clinging sand and the refractory coating) can also be used within the context of the present invention.

It should be understood that standard refractory coatings can be used for ductile iron as well as other metals that can be cast using the "lost foam" method. Refractory coatings are water based with an organic so that they will congeal very quickly on a wide variety of different types EPS forms of metal. This is important for controlling the coating thickness. Once the water is dried away (as part of step 23), the actual coating remaining on the form, can be graphite, zircon, perlite, marshalite, or other ceramics and/or sands. All of these coating materials can be adjusted in composition and thickness for the particular metal being cast.

While ductile iron with a carbide inducing agent is the preferred system to be used with the process of the present invention, the inventive process can be used with other types of ferrous metals and alloying agents. The type of metal to be used will determine the best type of alloying agent and refractory coating. This will also be dictated in part by the requirements for the final cast product.

For example, the inventive process can be applied to cast steel. However, there are additional problems for the use of steel for "lost foam" casting. One such problem has been the erratic pick up of carbon from the vaporization of polystyrene foam. Nonetheless, steel can be provided with the carbidic coating at various portions of the casting using the process of the present invention.

One example is the use of a niobium coating on steel which would directionally allow the steel crystalline structure from the surface such that a finer structure would form and stop crack formation and propagation.

The use of carbidic adders to grey iron is already known. However, because of the substantial differences between ductile iron and grey iron, the use of carbiding agents in any ductile iron facility has been anathema. This is due to the random distribution of carbides through a casting using conventional techniques. It is only the precise technique of applying a carbidic layer of the present invention that makes it practical to use carbiding agents in a ductile iron facility. Without the present invention, the use of carbiding agents in any manner with ductile iron is considered entirely improper.

While a number of embodiments of the present invention have been described by way of example, the present invention is not limited thereto. Rather, the present invention should be understood to include any and all variations, permutations, adaptations, derivations, modifications, and embodiments that would occur to one that is skilled in this technology and in possession of the teachings of the present invention.

Accordingly, the present invention should be construed as being limited only by the following claims.

I claim:

1. A lost form method of forming, an as cast, ductile iron casting with a carbide surface layer on at least one preselected surface area of said ductile iron casting, said method comprising the steps of:

a) providing a vaporizable form in the shape of said ductile iron casting;

b) applying a carbidic formation agent to at least one preselected surface area of said form, corresponding to said at least one preselected surface area of said ductile iron casting to be formed;

c) placing said form in a container and surrounding said form with sand; and, d) applying molten ductile iron to said container, vaporizing said form to create said ductile iron casting having a carbide layer on said at least one preselected surface area.

2. The lost form method of claim 1, wherein said form comprises a polystyrene material.

3. The lost form method of claim 2, wherein step (b) of applying a carbidic formation agent further comprises the additional substep of applying a refractory coating over the form and the carbidic formation agent.

4. The lost form method of claim 3, wherein said form in said container is surrounded by an unbonded, non-siliceous sand.

5. The lost form method of claim 4, wherein step (b) of applying said carbidic formation agent is carried out by using at least one of a sprayer and a paint brush.

6. The lost form method of claim 3, wherein said carbidic formation agents are selected from a group consisting of: tellurium; vanadium; chromium; and niobium.

7. The lost form method of claim 3, further comprising the step of:

(e) removing said ductile iron casting from said container.

8. The lost form method of claim 7, further comprising the step of:

(f) removing said refractory coating from said ductile iron casting.

9. The lost form method of claim 8, wherein said refractory coating is removed by shot-blasting.

10. The lost form method of claim 9, wherein steps a-f render said casting sufficiently smooth for use without further machining.

11. The lost form method of claim 1, wherein said carbide surface layer comprises iron carbide having a thickness between 0.001 and 0.25 inch.

* * * * *